US006533998B2

(12) United States Patent
Van Eldijk et al.

(10) Patent No.: US 6,533,998 B2
(45) Date of Patent: Mar. 18, 2003

(54) PROCESS FOR PRODUCING NODULAR CAST IRON, AND CASTING PRODUCED USING THIS PROCESS

(75) Inventors: Pieter Cornelis Van Eldijk, Ijmuiden (NL); Frans-Benoni Lietaert, Gent (BE)

(73) Assignee: Corus Technology B.V., CA IJmuiden (NL)

( * ) Notice: Subject to any disclaimer, the term of this patent is extended or adjusted under 35 U.S.C. 154(b) by 0 days.

(21) Appl. No.: 09/780,667

(22) Filed: Feb. 12, 2001

(65) Prior Publication Data

US 2001/0024622 A1 Sep. 27, 2001

(30) Foreign Application Priority Data

Feb. 16, 2000 (NL) ..... 1014394

(51) Int. Cl.[7] ..... C22C 37/04; C21B 1/10

(52) U.S. Cl. ..... 420/18; 420/13; 420/33; 75/520; 75/10.51; 75/10.47

(58) Field of Search ..... 420/13, 18, 33; 75/520, 10.51, 10.47; 148/321

(56) References Cited

U.S. PATENT DOCUMENTS

| | | | | |
|---|---|---|---|---|
| 4,432,793 A | | 2/1984 | Hilaire et al. | |
| 4,889,688 A | * | 12/1989 | Suenaga et al. | 420/20 |
| 5,186,233 A | | 2/1993 | Obata et al. | |

FOREIGN PATENT DOCUMENTS

| | | |
|---|---|---|
| EP | 0317366 | 5/1989 |
| EP | 1126037 | 8/2001 |
| FR | 2511044 | 2/1983 |
| JP | 50037607 | 12/1975 |
| WO | 0153545 | 7/2001 |

OTHER PUBLICATIONS

Best, K.J., "Behandlung Von Gusseisenschmelzen Mit Magnesiumbehandlungsdraht Und Impfdraht Zur Erzeugung Von Serienteilen Aus Gusseisen Mit Kugelgraphit Und Mit Vermiculargraphit", Paper No. XP000013180, vol. 76, No. 3 (Feb., 1989) with English language summary and English language translation of section entitled Impfen.

EMAS Publishing "ECF 12, Fracture from Defects", Proceedings of the 12th Bienniel Conference on Fracture, Engineering Materials Advisory Services, Ltd., vol. 2, (Sep. 1998).

van Eldijk, Cees, "Dun nodular gietijzer Een ijzersterk perspectief (Thin nodular cast iron– an excellent prospect)", GietwerkPerspectief, Jrg. 17, No. 3, pp. 25–30 (May/Jun. 1997) with English language summary.

van Eldijk, P.C. et al "Dunwahndig nodular gietijzer voor automotive toepassingen (Thin–walled nodular cast iron for automotive applications)", GietwerkPerspectief, Jrg. 14, No. 5, (Sep./Oct. 1994) with English language summary.

Zuidema, Jan et al, "Fatigue of Nodular Cast Iron", Fatigue '99, vol. 3, pp. 2071–2076, Proceedings of the Seventh International Fatigue Conference, Beijing, P.R.C.(1999).

(List continued on next page.)

*Primary Examiner*—Deborah Yee
(74) *Attorney, Agent, or Firm*—Stevens, Davis, Miller & Mosher, LLP

(57) ABSTRACT

The invention relates to a process for producing nodular cast iron with a high number of graphic nodules. This process comprises the following steps: preparing molten base iron for wasting castings of nodular cast iron; adding Mg to the molten base iron; inoculating the casting stream with a first inoculant when casting the cast iron into a casting mold. According to the invention, between the addition of the Mg and the inoculation of the casting stream, a preliminary inoculation using a further inoculant is carried out as an additional step. The invention also relates to a casting obtained by using this process.

19 Claims, 1 Drawing Sheet

OTHER PUBLICATIONS

Figure 1:
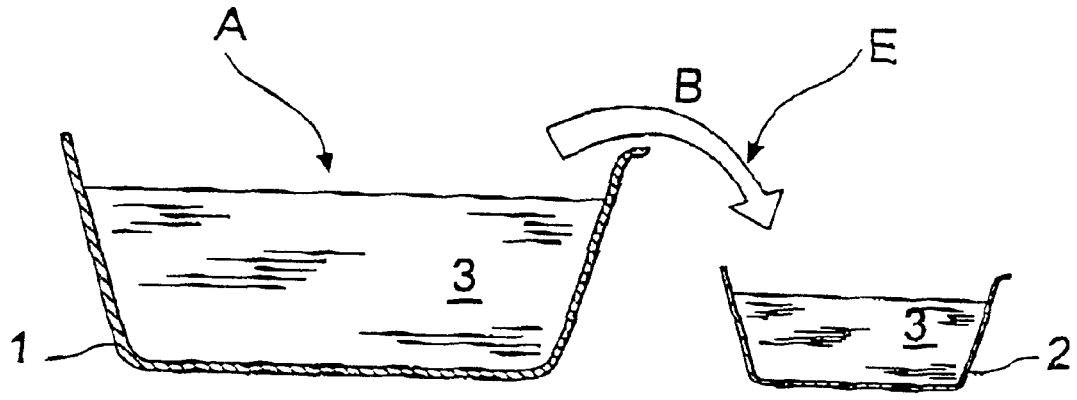

Janssen, M. et al, "Fracture Toughness of Thin Nodular Cast Iron: Determination and Effect of Nodular Morphology", Microstructural Influences, Progress in Mechanical Behaviour of Materials, Proceedings of the Eighth International Conference on the Mechanical Behavior of Materials, ICM8, vol. I.2, pp. 36–41 (1999).

* cited by examiner

PROCESS FOR PRODUCING NODULAR CAST IRON, AND CASTING PRODUCED USING THIS PROCESS

The invention relates to a process for the production of nodular cast iron with a large number of graphite nodules. The invention also relates to a casting produced using this process.

The production of castings, compared to welding, machining or deforming metal, has the considerable advantage that a product can be formed in one go and then scarcely requires any further treatment. The designer of a product also has considerable design freedom when determining the shape of the casting, and the castings can be produced in large numbers at relatively low cost. However, it is a drawback that most metals, such as aluminium and steel, shrink considerably during solidification, with the result that internal shrinkage cavities are formed and it is difficult or impossible to prevent porosity.

Cast iron behaves differently, since during solidification the carbon in the molten material is precipitated in the form of graphite particles. This formation of graphite goes hand-in-hand with an increase in volume, so that it is possible to compensate for the shrinkage of the iron. As a result, cast iron can in principle be free of shrinkage cavities and porosity.

With nodular cast iron, graphite particles which are more or less spheroidal are formed, so that they cause less of a notch effect in the cast iron. Consequently, nodular cast iron has mechanical properties which are comparable to those of steel.

Although the mechanism of nodule formation in nodular cast iron is not yet fully known, in practice a number of standard treatment techniques have been developed and patented. The starting point is a cast iron with a basic composition, the so-called base iron, containing, for example, 3.5% C, 2% Si, <0.02% S, and other standard alloying elements which have a controllable influence on the graphite structure. During the preliminary treatment, which is usually carried out in a treatment ladle or casting ladle, magnesium is usually added to the molten material n order to achieve a freely dissolved magnesium content of 0.015 to 0.06% Mg±0.005%. Often, small amounts of cerium, calcium and any other alkaline metal and alkaline-earth metal elements are also added. This preliminary treatment is known as nodulization or Mg treatment. After this nodulization, an inoculant is added to the cast iron, so that inoculation nuclei are formed in the molten material, around which inoculation nuclei the carbon can crystallize out in the form of graphite. This treatment is known as inoculation. Various compositions are in use as inoculant. The inoculant is preferably only added to the casting stream at the last moment, for example in the form of grains which just have time to dissolve in the molten material. It has been found that earlier addition of inoculant leads to a lower number of nodules per $mm^2$ in the nodular cast iron. To carry out the nodulization and inoculation in one treatment following the casting process, it is possible to use a device in which the reactions generally take place under an inert protective gas.

A process of this type is described in French Patent 2511044. According to this document, an inoculant bearing the tradename "Sphérix" is used, comprising a ferrosilicon alloy with 70–75% silicon, containing 0.005% to 3% of at least one of the metalloids bismuth, lead or antimony, and 0.005% to 3% of at least one metal from the group of rare earths. (All percentages in this text are given as percent by weight).

It is generally known that in practice it is very difficult to use conventional casting techniques to produce castings with a wall thickness of less than 5 mm which are free of primary carbides if unheated sand moulds and gravity die-casting are used. with a wall thickness of less than 5 mm, the cooling rate during solidification in the sand mould into which the cast iron is poured is so high that, in an optimum nucleation state according to the methods known hitherto, there are insufficient nuclei for complete graphitization to preclude the lowest form of white solidification. The excessively long diffusion distances to the graphite nuclei which are present will cause some of the dissolved carbon to form primary carbides or cementite in accordance with the metastable Fe—C system instead of nodular graphite according to the stable Fe—C system.

It is an object of the invention to provide an improved process for the production of nodular cast iron.

It is another object to provide a process for producing thin nodular cast iron which is free of cementite without using a heat treatment specifically for this purpose.

It is yet another object to provide a process which prevents the formation of undesirable primary carbides in thin walls.

It is yet another object of the invention to provide a process with which a microstructure of nodular cast iron is obtained in relatively thin wall thicknesses.

It is another object of the invention to provide a relatively simple process with which castings made from nodular cast iron can be produced with thinner wall thicknesses than has hitherto been possible.

It is yet another object of the invention to provide a process with which thin walls of castings can be produced from nodular cast iron with a number of graphite nodules which is higher than customary.

It is yet another object of the invention to provide a process with which thin-walled castings can be produced from nodular cast iron with larger dimensions than has hitherto been possible.

Typically the casting, in a wall with a thickness of between 2 and 5 mm, has a predominantly ferritic steel matrix.

It is also an object of the invention to provide castings made from nodular cast iron in which the above objectives are achieved.

According to a first aspect of the invention, one or more of the above objects are achieved with a process for producing nodular cast iron with a high number of graphite nodules, comprising the following steps:

preparing molten base iron for casting castings of nodular cast iron;

adding Mg to the molten base iron;

using a casting stream to cast the cast iron into a casting mould, an inoculant being added to the casting stream, characterized in that between the addition of the Mg and the addition of the inoculant to the casting stream, a preliminary inoculation using a further inoculant is carried out as an additional step.

Surprisingly, it has been found that adding a further inoculant during an additional step has a very favourable effect on the number of graphite nodules formed. This preliminary inoculation with the further inoculant is all the more surprising since hitherto it has always been observed that the casting-stream inoculant should be added as late as possible in the process in order to form as many inoculation nuclei in the molten material as possible. When the inoculant was added earlier, it was observed that the effect of adding the inoculant decreased. Therefore, hitherto the inoculant has only been added to the casting stream which is used to fill the casting moulds. This addition takes place in an accurately metered manner.

With the process according to the invention, in which the further inoculant is added as an additional step, it is possible to produce castings from nodular cast iron in a conventional way without an additional heat treatment being required, while the castings can have walls with a wall thickness which is less than the previously customary minimum wall thickness of 5 mm. It has proven possible, with the aid of the process according to the invention, to produce castings from nodular cast iron with walls with a wall thickness of between 2 mm and 5 mm without white cast iron being formed. The process according to the invention is therefore eminently suitable for the production of components for the automotive industry which are subjected to relatively heavy loads and have hitherto been produced by, for example, welding from steel sheet.

Preferably, the preliminary inoculation with the further inoculant is carried out at most approximately 30 minutes before casting, preferably at most 15 minutes before casting. The preliminary inoculation can then be carried out well before the actual casting process, without the time at which the preliminary inoculation is to take place being critical.

According to one embodiment of the process, the Mg is added in a treatment or casting ladle and the further inoculant is added to the treatment or casting ladle packaged in a wire component. In this embodiment of the process, the treatment ladle also serves as casting ladle for casting the cast iron into the casting mould. The preliminary inoculation with the further inoculant in the form of a wire component is carried out independently and after the Mg treatment has beer completed.

According to another embodiment of the process, the Mg is added in a treatment ladle and the further inoculant is added to a casting stream leading from the treatment ladle into a casting ladle. In this embodiment of the process, the cast iron is firstly poured from the treatment ladle into a casting ladle. During this step, the further inoculant is added, so that the preliminary inoculation with the further inoculant is therefore carried out independently of the Mg treatment and is also spatially separate therefrom.

Advantageously, the further inoculant is identical to the casting-stream inoculant. It is then possible to make do with one type of inoculant, so that there can be no confusion as to which inoculant is to be used when.

The first inoculant preferably consists of a FeSi alloy containing approximately 70% Si and approximately 0.4% Ce misch-metal, 0.7% Ca, 1.0% Al and 0.8% Bi, and inevitable trace elements.

According to a preferred process, approximately 0.3% of the further inoculant is added during the additional step, the further inoculant having the same composition as the casting-stream inoculant. This quantity of the further inoculant with the abovementioned composition is sufficient to form a sufficiently high number of inoculation nuclei, obviously in conjunction with the use of the casting-stream inoculant.

Preferably, the amount of C in the base iron is made to be greater than or equal to 3.7% and the amount of Si is made to be as high as possible, so that it is possible to cast thin-walled castings. This composition of the molten material, in conjunction with the inoculants, has a beneficial effect on the number of graphite nodules formed.

For castings with a wall thickness of approximately 2 mm, it is preferable to use base iron containing approximately 4.0% C, and for castings with a wall thickness of approximately 3 mm it is preferable to use base iron containing approximately 3.8% C.

The Mg is preferably added as pure Mg or as a prealloy, such as NiMg15 or FeSiMg.

According to a preferred process, after the addition of Mg the amount of free Mg in the molten base iron is equal to approximately 0.020% for castings which are to be cast with a wall thickness of approximately 2 mm, is approximately 0.025% for castings with a wall thickness of approximately 3 mm, and is approximately 0.030% for a wall thickness of approximately 4 mm.

Preferably, a greater amount of casting-stream inoculant is added as the desired wall thickness of the casting to be cast becomes thinner. The addition of more casting-stream inoculant results in more inoculation nuclei being formed in the molten material and therefore more graphite nodules being formed in the casting. A greater number of graphite nodules is desired as the wall becomes thinner.

A second aspect of the invention provides a casting made from nodular cast iron which according to the invention has a wall with a wall thickness of less than approximately 5 mm, in particular 2 to 4 mm, by using the process described above. Castings of this type made from nodular cast iron which have at least one wall with a wall thickness of less than 5 mm are for many application areas, such as the automotive industry, a good substitute for traditionally formed components, such as heavy nodular cast iron, forgeable steel, cast steel or a welding composition, or for non-traditionally formed components, such as a heat-treated Al casting, since they can be produced at lower cost in greater numbers and are also lighter in weight, while also satisfying the functional requirements, in particular with regard to the strength.

The number of graphite nodules per $mm^2$ in the casting preferably increases as the wall thickness becomes smaller, preferably being approximately 2000 nodules per $mm^2$ for a wall thickness of approximately 3 mm and preferably being approximately 6000 nodules per $mm^2$ for a wall thickness of approximately 2 mm. A number of nodules of this level is desirable in order to prevent white solidification of the cast iron at such thicknesses.

The casting preferably has dimensions which are at most 300 by 300 by 400 mm. These dimensions are large enough for most applications in which thin-walled castings can be used.

Figure 2:
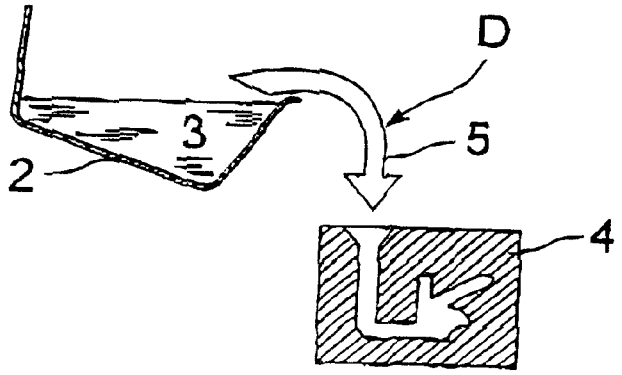

The invention will be explained on the basis of an exemplary embodiment and with reference to the drawing, in which:

FIG. 1 diagrammatically depicts a treatment ladle and a casting ladle for the Mg treatment and preliminary inoculation;

FIG. 2 diagrammatically depicts the casting of a casting and the inoculation.

When castings are produced in the customary way from nodular cast iron, a molten metal is formed from base iron 3 containing approximately 3.5% C, 2% Si and <0.02% S, as well as further standard alloying elements which as far as is known have a manageable influence on the graphite structure. The base iron is transferred into a treatment ladle 1, cf. FIG. 1, in which magnesium is added to the molten material, cf. arrow A in FIG. 1. The magnesium is added as pure magnesium or as a magnesium alloy, such as NiMg15 or FeSiMg. A freely dissolved Mg content of 0.015–0.06% Mg±0.005% should be achieved. The pure magnesium can be supplied as a wire which is filled with magnesium or with an Mg prealloy, so that there is no risk of the magnesium being oxidized or evaporating prematurely. Small quantities of cerium and/or calcium and the like are often also added deliberately.

After this so-called Mg treatment, some of the molten material is transferred into a casting ladle 2, cf. arrow B in FIG. 1. FIG. 2 shows that the molten iron 3 is poured out of the casting ladle 2 into a casting mould 4, an inoculant being added to the casting stream 5 during the casting, cf. arrow D. There are numerous compositions in use as inoculant for forming a large number of inoculation nuclei in the molten material. One of these inoculants is Sphérix, cf. French Patent 2511044, consisting of ferrosilicon containing 70–75% silicon with 0.005 to 3% of at least one of the metals bismuth, lead or antimony, and 0.005 to 3% of a metal selected from the group of rare earths. The inoculant is added as late as possible before filling of the casting mould, since it has been found that the effect of the addition of the inoculant otherwise decreases.

According to the invention, a further inoculant is added, cf. arrow E in FIG. 1. This further inoculant may easily be added to the molten material a quarter of an hour before the casting mould 4 is filled and yet still has a favourable effect on the formation of inoculation nuclei and on achieving a large number of graphite nodules in the casting, so that the casting may have walls with a wall thickness of thinner than 5 mm.

As the wall thickness decreases from a thickness of 5 mm to a minimum possible thickness of 2 mm, it is desirable for the percentage of C in the base iron to increase from approximately 3.5% to approximately 4.0%, while at the same time the percentage of Si used is made to be as high as possible, but falling from approximately 2.8% to approximately 2.5% as the percentage of C increases.

When using the process according to the invention, it has been found that an inoculant made from a FeSi alloy containing approximately 70% Si and approximately 0.4% Ce misch-metal, 0.7% Ca, 1.0% Al and 0.8% Bi and inevitable trace elements provides the best results compared to processes known hitherto. This inoculant can then be used both for the casting-stream inoculation and for the further inoculation.

Approximately 0.3% of the further inoculant is used for the preliminary inoculation. An increasing percentage of the casting-stream inoculant is used as the desired thickness of the wall decreases, rising to approximately 0.8% for a wall thickness of 2 mm, while an increasing % C and % Si allows a lower % inoculant to be used.

It is also desirable for the percentage of Mg to be low and to become lower as the wall thickness decreases. For a wall thickness of 2 mm, the percentage of free Mg should be approximately 0.02%, for a wall thickness of 3 mm it should be approximately 0.025%, and for a wall thickness 4 mm it should be approximately 0.03%.

With the process for casting castings from nodular cast iron according to the invention, it is possible to cast castings with at least one wall with a wall thickness of approximately 2 mm, while the casting may have a maximum size of 300 by 300 by 400 mm.

When using the process according to the invention, with a wall thickness of 2 mm it is possible to form approximately 6000 nodules per $mm^2$, and for a wall thickness of 3 mm it is possible to form approximately 2000 nodules per $mm^2$. For these thicknesses, nodular cast iron which has been treated in a conventional way has approximately 550 to 1000 nodules per $mm^2$.

The invention has been described above on the basis of an exemplary embodiment. It will be understood that the invention is not restricted to this example; the scope of protection is determined by the claims which follow.

What is claimed is:

1. Process for producing nodular cast iron with a high number of graphite nodules, comprising the following steps:

preparing molten base iron for casting castings of nodular cast iron;

adding Mg to the molten base iron;

using a casting stream to cast the cast iron into a casting mould, an inoculant being added to the casting stream, wherein between the addition of the Mg and the addition of the inoculant to the casting stream, a preliminary inoculation using a further inoculant is carried out as an additional step.

2. Process according to claim 1, wherein the preliminary inoculation is carried out at most approximately 30 minutes before casting.

3. Process according to claim 1, wherein the Mg is added in a treatment or casting ladle, and the further inoculant is added to the treatment or casting ladle packaged in a wire component.

4. Process according to claim 1, wherein the Mg is added in a treatment ladle, and the further inoculant is added to a casting stream leading from the treatment ladle into a casting ladle.

5. Process according to claim 1, wherein a further inoculant which is identical to the casting-stream inoculant is used.

6. Process according to claim 1, wherein the casting-stream inoculant is composed of an FeSi alloy containing approximately 70% Si, approximately 0.4% Ce misch-metal, 0.7% Ca, 1.0% Al and 0.8% Bi, and inevitable trace elements.

7. Process according to claim 1, wherein during the additional step approximately 0.3% of the further inoculant is added, the further inoculant composed of an FeSi alloy containing approximately 70% Si, approximately 0.4% Ce misch-metal, 0.7% Ca, 1.0% Al and 0.8% Bi, and inevitable trace elements.

8. Process according to claim 1, wherein in the base iron the amount of C is made to be greater than or equal to 3.7%, and the amount of Si is made to be as high as possible, so that it is possible to cast thin-walled castings which are free of primary carbides.

9. Process according to claim 8, wherein for castings with a wall thickness of approximately 2 mm, base iron containing approximately 4.0% C is used and for castings with a wall thickness of approximately 3 mm, base iron containing approximately 3.8% C is used.

10. Process according to claim 1, wherein the Mg is added as pure Mg or as a prealloy.

11. Process according to claim 1, wherein after the addition of Mg the amount of free Mg in the molten base iron is equal to approximately 0.020% for castings which are to be cast with a wall thickness of approximately 2 mm, is approximately 0.025% for castings with a wall thickness of approximately 3 mm, and is approximately 0.030% for castings with a wall thickness of approximately 4 mm.

12. Process according to claim 1, wherein a greater amount of casting-stream inoculant is added as the desired wall thickness of the casting to be cast becomes thinner.

13. Casting according to claim 1, wherein the casting has a wall with a wall thickness of approximately 2 mm and wherein said wall contains approximately 6000 nodules per $mm^2$.

14. Casting according to claim 13, wherein the casting has more graphite nodules per $mm^2$ as the wall thickness becomes smaller.

15. Casting according to claim 13, wherein the dimensions of the casting are at most 300 by 300 by 400 mm.

16. Casting according to claim 13, wherein the casting has a predominantly ferritic steel matrix.

17. Casting made from nodular cast iron according to claim 16, wherein the number of graphite nodules per $mm^2$ of the casting increases as the wall thickness becomes smaller.

18. Process according to claim 1, wherein the preliminary inoculation is carried out at most 15 minutes before casting.

19. The process of claim 10, wherein the prealloy is selected from the group consisting of NiMg15 and FeSiMg.

* * * * *